United States Patent [19]

Sakuranaka et al.

[11] 4,316,441

[45] Feb. 23, 1982

[54] FUEL INJECTION ADVANCE ANGLE CONTROL APPARATUS

[75] Inventors: Toru Sakuranaka; Masayoshi Kobayashi; Sachio Nakagawa, all of Higashi Matsuyama, Japan

[73] Assignee: Diesel Kiki Company, Ltd., Tokyo, Japan

[21] Appl. No.: 56,567

[22] Filed: Jul. 11, 1979

[30] Foreign Application Priority Data

Sep. 29, 1978 [JP] Japan ..... 53-133561[U]

[51] Int. Cl.[3] ..... F02D 1/12

[52] U.S. Cl. ..... 123/502; 123/179 L

[58] Field of Search ..... 123/139 ST, 139 AQ, 123/139 AP, 140 FG, 502, 501, 500, 179 L

[56] References Cited

U.S. PATENT DOCUMENTS

| | | | |
|---|---|---|---|
| 2,910,975 | 11/1959 | Evans | 123/139 AQ |
| 3,147,746 | 9/1964 | Hofer | 123/139 AQ |
| 3,943,902 | 3/1976 | Skinner | 123/139 AQ |
| 4,050,433 | 9/1977 | Tokashiki | 123/139 AQ |
| 4,143,632 | 3/1979 | Kobayashi | 123/139 AQ |

*Primary Examiner*—Charles J. Myhre
*Assistant Examiner*—Carl Stuart Miller
*Attorney, Agent, or Firm*—David G. Alexander

[57] ABSTRACT

In a distribution type fuel injection system, the injection advance angle, or the relative angular position at which fuel injection begins, is controlled by a first spring loaded piston (44). The spring force is opposed by pressurized fuel from a pump (14), the pressure increasing with engine speed. A second spring loaded piston (49) moves the first piston (44) to an advanced position for starting the engine and is retracted when the fuel pressure reaches a certain value to retard the advance angle in an idling speed range. The fuel pressure moves the first piston (44) to progressively advance the angle in a higher speed range. An O-ring (61) is provided to an end of the second piston (49) which abuts against an end wall (53) so that the fluid pressure receiving area of the second piston (49) is small when the second piston (49) abuts against the end wall (53) but is greater when the second piston (49) is moved away from the end wall (53). The effect is that the second piston (49) is prevented from moving and retarding the advance angle until the engine speed and fuel pressure reach a relatively high value upon starting of the engine. Thereafter, the advance angle will be retarded upon a return of the engine speed to the idling range.

5 Claims, 4 Drawing Figures

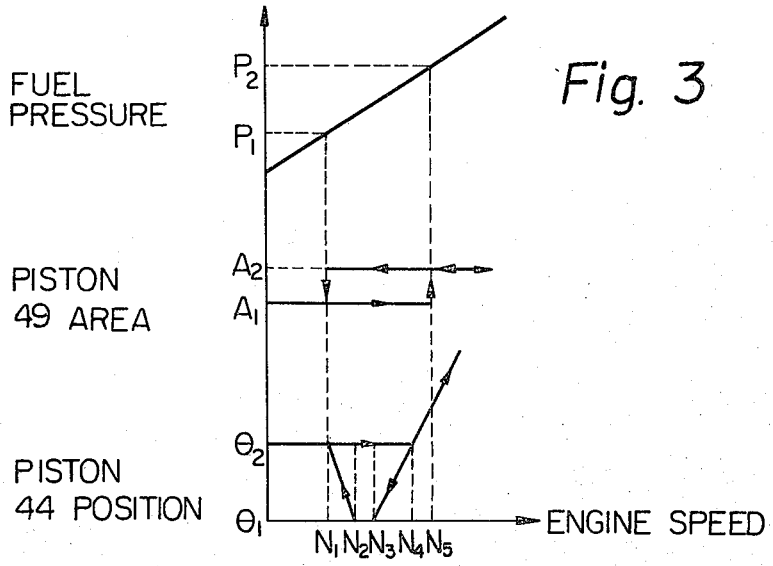
Fig. 3
Fig. 4
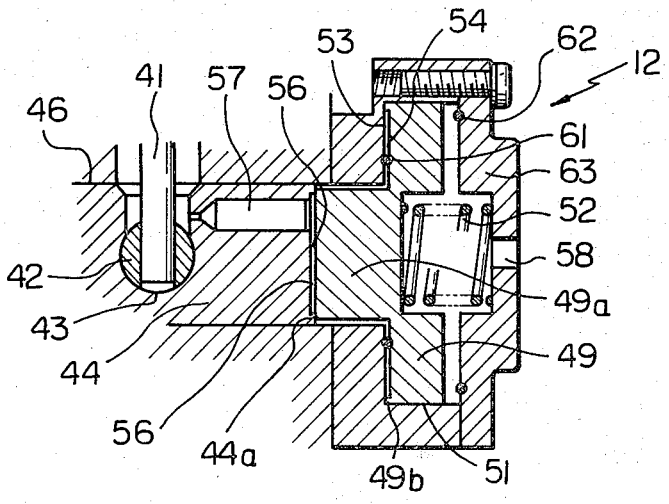

FUEL INJECTION ADVANCE ANGLE CONTROL APPARATUS

BACKGROUND OF THE INVENTION

The present invention relates to a fuel injection advance angle control apparatus for an internal combustion engine such as a Diesel engine.

Fuel injection systems are popular in the field of internal combustion engines due to their many advantages, especially where adapted to combustion ignition or Diesel engines. Typical of such systems is the distribution system in which a plunger is simultaneously rotated and reciprocated to pump fuel to injection nozzles of a number of engine cylinders.

The performance and efficiency of the engine depend on fuel injection at the right time and in the right amount. The problem is complicated by the fact that the proper time for fuel injection is a function not only of engine speed but also engine operating conditions such as starting, idling, high speed running and the like.

Generally, it is necessary to progressively increase the fuel injection advance angle as the engine speed increases. What is meant by the advance angle is the relative angular position in the engine operating cycle at which fuel injection is initiated and may be considered as the number of degrees before the engine piston reaches top dead center at which fuel injection begins. In addition to the basic relationship between advance angle and engine speed, it is also necessary to advance the angle upon starting the engine and retard the angle for idling.

A known system for achieving this operation comprises an engine driven pump which pumps fuel from a reservoir or tank at a pressure which increases with engine speed. The pressurized fuel is applied to a spring loaded piston which is connected to an advance angle control mechanism. The fuel pressure balanced against the spring force positions the piston which in turn sets the advance angle at a value which corresponds to the position of the piston. In this manner, the advance angle is increased as the engine speed increases.

The advance angle is increaed upon starting by another spring loaded piston which moves the main piston to an advanced position at low engine speed. As the engine speed and fuel pressure increase, the secondary piston is retracted and the main piston allowed to move to a retarded position for constant speed idling. Further increase in the engine speed and fuel pressure cause the main piston to be moved from the retarded position in the normal manner to increase the advance angle.

A problem in this basic system is that the fuel pressure increases quickly upon starting and the advance angle is changed from the advanced to the retarded value before stable combustion is attained in the engine. This results in extreme difficulty in starting the engine since the advance angle is retarded prematurely while the engine temperature is still low.

SUMMARY OF THE INVENTION

A fuel injection control apparatus for an engine embodying the present invention includes a housing having a first bore, a second bore having an end wall, the first bore colinearly communicating with the second bore through said end wall, a diameter of the second bore being larger than a diameter of the first bore, a first piston slidable in the first bore and being connected so that a fuel injection advance angle of the apparatus corresponds to a position of the first piston, a second piston slidable in the second bore, a first spring urging the first piston toward abutment with the second piston, a second spring urging the second piston toward abutment with said end wall, engine driven pump means for pumping fuel at a pressure which increases with engine speed and a passageway connecting the pump means with a space between adjacent ends of the first and second pistons respectively. An annular seal is coaxially disposed between said end wall of the second bore and the second piston, the inner diameter of the seal being larger than the diameter of the first bore and the outer diameter of the seal being smaller than the diameter of the second bore, whereby the fluid receiving area of the second piston is relatively small when the second piston abuts against the end wall and is greater when the second piston is moved away from the end wall.

In accordance with the present invention, in a distribution type fuel injection system, the injection advance angle, or the relative angular position at which fuel injection begins, is controlled by a first spring loaded piston. The spring force is opposed by pressurized fuel from a pump, the pressure increasing with engine speed. A second spring loaded piston moves the first piston to an advanced position for starting the engine and is retracted when the fuel pressure reaches a certain value to subsequently retard the advance angle in an idling speed range. The fuel pressure moves the first piston to progressively advance the angle in a higher speed range. An O-ring is provided to an end of the second piston which abuts against an end wall so that the fluid pressure receiving area of the second piston is small when the second piston abuts against the end wall but is greater when the second piston is moved away from the end wall. The effect is that the second piston is prevented from moving and retarding the advance angle until the engine speed and fuel pressure reach a relatively high value upon starting of the engine. Thereafter, the advance angle will be retarded upon a return of the engine speed to the idling range.

It is an object of the present invention to provide a fuel injection advance angle control apparatus for a distribution type fuel injection system for an internal combustion engine which overcomes the drawbacks of the prior art and operates in a stable and efficient manner.

It is another object of the present invention to provide a fuel injection advance control apparatus which provides easy and stable starting, idling and high speed operation of an internal combustion engine.

It is another object of the present invention to provide a fuel injection advance control apparatus which may be advantageously and economically manufactured, installed and maintained on a commercial production basis.

It is another object of the present invention to provide a generally improved fuel injection advance control apparatus for an internal combustion engine.

Other objects, together with the foregoing, are attained in the embodiment described in the following description and illustrated in the accompanying drawing.

BRIEF DESCRIPTION OF THE DRAWING

FIG. 3 is a graph illustrating the operation of the present invention; and

FIG. 4 is an enlarged view illustrating a novel feature of the present invention.

DESCRIPTION OF THE PREFERRED EMBODIMENT

While the fuel injection advance angle control apparatus of the present invention is susceptible of numerous physical embodiment, depending upon the environment and requirements of use, substantial numbers of the herein shown and described embodiment have been made, tested and used, and all have performed in an eminently satisfactory manner.

Figure 1:
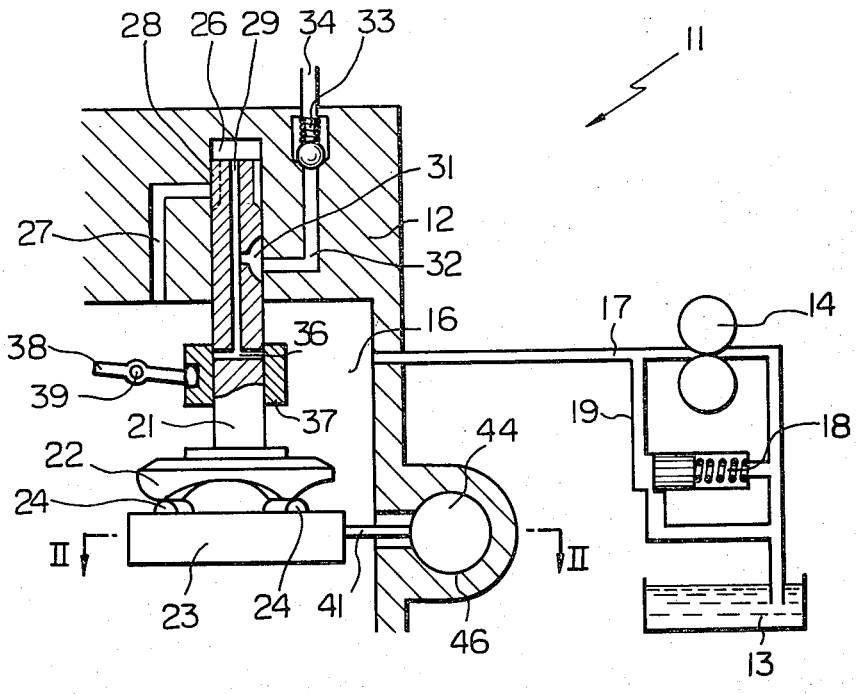
FIG. 1 is a schematic diagram of a fuel injection advance control apparatus embodying the present invention.
Figure 2:
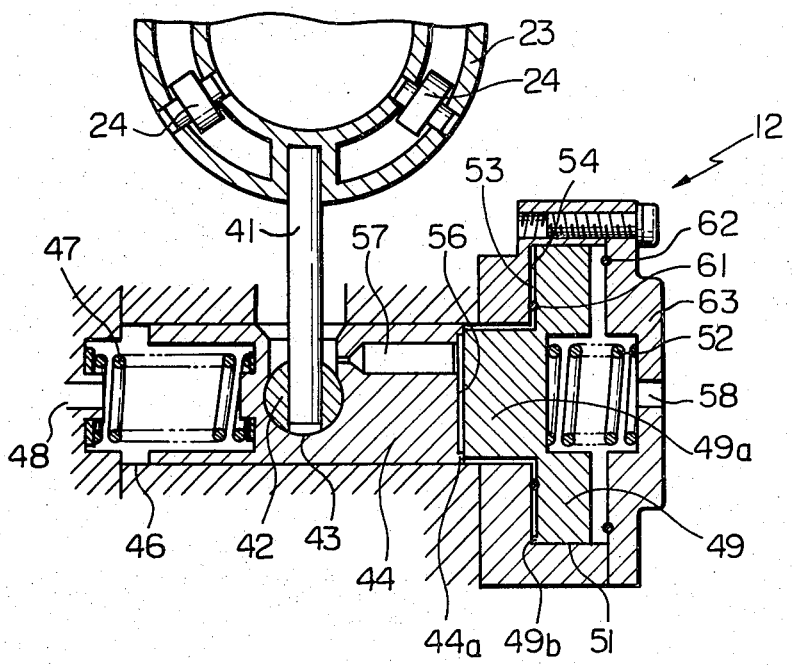
FIG. 2 is a section taken on a line II—II of FIG. 1.

Referring now to FIGS. 1 to 4 of the drawing, a fuel injection advance angle control apparatus embodying the present invention is generally designated by the reference numeral 11 and comprises a housing 12. Liquid fuel such as diesel oil is provided in a reservoir or tank 13. A pump 14 feeds fuel from the tank 13 to a chamber 16 in the housing 12 through a line 17. A pressure relief valve 18 is provided in a bypass line 19 to prevent the pressure in the line 17 from exceeding a maximum value.

The pump 14 is driven by an internal combustion engine (not shown) which utilizes the apparatus 11 for fuel injection and is constructed so that the output fuel pressure in the line 17 increases in a preferably linear manner as the engine speed (revolutions per minute) increases.

The apparatus 11 is illustrated as being incorporated in a distribution type fuel injection system although it clearly may be adapted to control the injection advance angle in other types of fuel injection systems. A piston or plunger 21 is rotatably driven by the engine, although the drive connection is not shown. A cam disc 22 is fixed to the lower end of the piston 21 and urged by a spring (not shown) into engagement with a roller carrier 23. The carrier 23 is in the form of a disc and carries balls or rollers 24 in recesses (not designated) in its upper surface which rollingly engage with the cam 22. The lower surface of the cam 22 is formed with projections (not designated) in a number equal to the number of cylinders of the engine. Rotation of the piston 21 causes the cam 22 to ride up and down on the rollers 24 and thereby causes the piston 21 to reciprocate in a bore 26 of the housing 12.

During a downward or return stroke of the piston 21, fuel from the chamber 16 flows into the upper closed end of the bore 26 through a passageway 27 formed through the housing 12 and an annular groove 28 formed in the upper end of the piston 21.

As the piston 21 moves upward during a fuel injection stroke, the lower end of the groove 28 moves above the opening of the passageway 27 so that the passageway 27 no longer communicates with the upper portion of the bore 26. This causes fuel to be compressed and displaced through an axial passageway 29 in the piston 21 and a distribution groove 31 which communicates with the passageway 29 into an outlet passageway 32 formed through the housing 12. When the pressure in the passageway 32 reaches a sufficiently high value, the fuel is fed through a check valve 33 and line 34 to a fuel injection nozzle (not shown) and thereby into the engine cylinder.

The piston 21 is further formed with a radial passageway 36 which leads from the axial passageway 29. A sleeve 37 is slidably disposed around the piston 21. The sleeve 37 is positioned so as to cover the passageway 36 and allow the piston 21 to compress fuel in the bore 26 and displace the same through the passageway 32 for fuel injection. However, after the piston 21 has moved upwardly to a certain extent, the opening of the passageway 36 moves above the upper end of the sleeve 37 and thereby communicates the upper portion of the bore 26 with the chamber 16 through the passageways 29 and 36. At this point, the pressure in the bore 26 drops almost instantaneously to the level of the pressure in the chamber 16 and the check valve 33 closes. This terminates fuel injection.

The sleeve 37 is positioned by a governor (not shown) through a lever 38 which is pivotal about a pin 39. Clockwise rotation of the lever 38 causes the sleeve 37 to move downwardly and decrease the amount of fuel injection and vice-versa. It will be understood that the vertical position of the sleeve 37 determines the point in the fuel injection cycle at which fuel injection terminates, and therefore the amount of fuel injection. The higher the sleeve 37, the larger the amount of fuel injection.

Although only one passageway 32 is shown, there are actually provided a number of similar passageways equal to the number of cylinders in the engine. The openings of the passageways 32 are equally circumferentially spaced from each other. Thus, rotation of the piston 21 causes fuel to be distributed to the engine cylinders through the passageways 32. Reciprocation of the piston 21 serves the function of compressively displacing fuel to the cylinders for injection.

The fuel injection advance angle is controlled by means of an arm 41 fixed at one end to the roller carrier 23. The carrier 23 is rotatable perpendicular to the plane of FIG. 1 and parallel to the plane of FIG. 2. The other end of the arm 41 is fixed to a ball 42 which is rotatably received in a socket 43 of a first or main piston 44. The piston 44 is slidable in a first bore 46 in the housing 12. Leftward movement of the piston 44 causes the roller carrier 23 to rotate clockwise in FIG. 2 and increase the advance angle of fuel injection. In other words, the larger the advance angle, the earlier before top dead center of the engine pistons (not shown) at which fuel injection begins.

The piston 44 is urged rightwardly by a compression spring 47. The left end portion of the bore 46 communicates through a line 48 with the reservoir or tank 13 which is non-pressurized, thereby allowing return of leaked fuel.

A second piston 49 is slidably disposed in a second bore 51 in the housing 12 and is urged leftwardly by a compression spring 52 toward abutment with an end wall 53 of the bore 51. The diameter of the bore 51 is larger than the diameter of the bore 46, the bores 51 and 46 colinearly communicating with each other through the end wall 53. An extension **49*a* of the piston 49 extends into the first bore 46 through the wall 53. The annular periphery of the left end of the piston 49 is raised as indicated at 49*b* so that when the piston 49 abuts against the wall 53 a space 54 is defined between the left end of the piston 49 inwardly of the raised portion 49*b* and the wall 53. The right end of the piston 44 is similarly raised as indicated at 44*a* so that when the piston 44 abuts against the extension 49*a* a space 56 is defined therebetween inwardly of the raised portion 44*a*. A passageway 57 communicates the chamber 16 with the space 56 so that pressurized fuel acts on the right end of the piston 44 against the force of the spring 47 and on the left end of the piston 49 against the force of the spring 52. The portion of the bore 51 rightward of the piston 49 is connected to the reservoir 13 through a line 58**.

The spring 52 is stronger than the spring 47. However, the area of the piston 49 (inwardly of the portion 49*b*) exposed to the pressure in the space 56 is larger than the area of the piston 44 (inwardly of the portion 44*a*) exposed to the pressure in the space 56.

In accordance with an important feature of the present invention, an annular O-ring seal 61 is fixed to the wall 53 coaxially surrounding the opening of the bore 46. The diameter of the O-ring 61 is larger than the diameter of the bore 46 but smaller than the diameter of the bore 51. It is clear that mechanically equivalent results may be obtained by fixing the O-ring 61 to the left end of the piston 49 rather than to the wall 53 in the illustrated position. Mechanically equivalent results may also be obtained if the bores 46 and 51, pistons 44 and 49 and O-ring 61 have a square, rectangular, hexagonal or other cross section rather than circular. Another O-ring 62 is fixed to an end wall 63 of the bore 51 to prevent leakage of fuel around the piston 49 when the piston 49 abuts against the end wall 63.

The important function of the O-ring 61 is to prevent the advance angle from being retarded until the engine is completely started and the engine speed has risen to a relatively high value N5 (see FIG. 3). The corresponding fuel pressure in the space 56 is P2.

When the engine is first started, the spring 52 moves the piston 49 leftwardly into abutment with the wall 53 and the spring 47 moves the piston 44 rightwardly into abutment with the extension 49*a*. The position of the piston 44 is designated as $\theta 2$ (see FIG. 3) which corresponds to a relatively advanced injection angle for starting. With the piston 49 in abutment with the wall 53, the O-ring 61 is compressed therebetween and provides an annular seal which prevents fuel from the space 56 from acting on the portion of the left end of the piston 49 radially outwardly of the O-ring 61. Thus, the pressure receiving area of the piston 49 is A1 and is equal to $\pi r1^2$, where r1 is the inner radius of the O-ring 61.

Due to the low pressure receiving area of the piston 49 as limited by the O-ring 61, the pressure in the space 56 is insufficient to overcome the preload of the spring 52 until the pressure P2 is reached. At this point, the force exerted by the fuel on the piston 49 is A1(P2). As soon as the piston 49 is moved rightwardly by fuel pressure, however, the piston 49 disengages from the O-ring 61 and the entire cross sectional area of the piston 49 is exposed to the fuel pressure in the space 56. The pressure receiving area becomes A2 which is equal to $\pi r2^2$, where r2 is the outer radius of the piston 49. The force of the fuel acting on the piston 49 is increased to A2(P2), and the piston 49 is driven rightwardly into abutment with the O-ring 62. The piston 49 is thereafter inoperative until the engine speed drops below N2, as will be understood from further description.

As the engine is started and the fuel pressure rises from zero toward N5, the pressure becomes sufficient at an engine speed N4 to overcome the preload of the spring 47. Thus, the piston 44 is moved leftwardly at engine speeds over N4 to advance the injection angle.

After the engine speed exceeds N5 and the piston 49 is moved rightwardly against the wall 63, the advance angle is controlled by the fuel pressure in the space 56 acting on the piston 44. As the engine speed decreases down to N3, the force of the spring 47 progressively overcomes the pressure in the space 56 and moves the piston 44 rightwardly toward the piston 49. At the engine speed N3, the piston 44 abuts against the piston 49. However, the piston 49 is still in its rightmost position so that the injection angle is retarded to a value corresponding to $\theta 1$, which is the rightmost position of the piston 44. The retarded value $\theta 1$ is suitable for a constant speed idling condition of the engine.

No change occurs between engine speeds N3 and N2 since the fuel pressure in the space 56 is still sufficient to completely overcome the force of the spring 52 and maintain the piston 49 in its rightmost position. However, at engine speeds from N2 to N1 the pressure in the space 56 decreases so that the spring 52 progressively moves the piston 49 leftwardly toward the wall 53. Since the spring 52 is stronger than the spring 47, the piston 44 is moved leftwardly along with the piston 49. At the engine speed N1, the pressure is P1, the piston 49 abuts against the wall 53 and the position of the piston 44 is $\theta 2$, a relatively advanced position for starting the engine. As the piston 49 abuts against the wall 53, the O-ring 61 is again compressed to reduce the pressure receiving area of the piston 49 from A2 to A1.

It will thus be seen that the present invention overcomes the problems of the prior art by preventing the injection advance angle from being retarded until the engine is started and operating in a stable manner. Thereafter, the advance angle is automatically retarded to provide stable and quiet idling. In addition, since the pressure in the space 56 drops to zero when the engine is shut down, the means for preventing the advance angle from being retarded until the engine speed N5 is reached will be automatically reset in readiness for starting the engine again.

Various modifications will become possible for those skilled in the art after receiving the teachings of the present disclosure without departing from the scope thereof.

What is claimed is:

1. A fuel injection control apparatus for an engine including a housing having a first bore, a second bore having an end wall, the first bore colinearly communicating with the second bore through said end wall, a diameter of the second bore being larger than a diameter of the first bore, a first piston slidable in the first bore and being connected so that a fuel injection advance angle of the apparatus corresponds to a position of the first piston, a second piston slidable in the second bore, a first spring urging the first piston toward abutment with the second piston, a second spring urging the second piston toward abutment with said end wall, engine driven pump means for pumping fuel at a pressure which increases with engine speed and a passageway connecting the pump means with a space between adjacent ends of the first and second pistons respectively, characterized by comprising an annular seal coaxially disposed between said end wall of the second bore and the second piston, the inner diameter of the seal being larger than the diameter of the first bore and the outer diameter of the seal being smaller than the diameter of the second bore, whereby the fluid pressure receiving area of the second piston is relatively small when the second piston abuts against the end wall and is greater when the second piston is moved away from the end wall.

2. An apparatus as in claim 1, in which the seal is fixed to said end wall.

3. An apparatus as in claim 1, in which the seal is fixed to said adjacent end of the second piston.

4. An apparatus as in claim 1, in which the seal is an O-ring.

5. An apparatus as in claim 1, in which the second spring is stronger than the first spring.

* * * * *